US011333310B2

(12) United States Patent
Mutch et al.

(10) Patent No.: US 11,333,310 B2
(45) Date of Patent: May 17, 2022

(54) POINT SOURCE LIGHT ASSEMBLY

(71) Applicant: Intense Lighting, LLC, Anaheim, CA (US)

(72) Inventors: Eric J. Mutch, Orange, CA (US); Xin Guo, Invine, CA (US); Marcus J. Worthington, Great Dunmow (GB); Greg A. Kuhl, East Leake (GB)

(73) Assignee: Intense Lighting, LLC, Anaheim, CA (US)

( * ) Notice: Subject to any disclaimer, the term of this patent is extended or adjusted under 35 U.S.C. 154(b) by 0 days.

(21) Appl. No.: 17/231,199

(22) Filed: Apr. 15, 2021

(65) Prior Publication Data

US 2021/0332957 A1 Oct. 28, 2021

Related U.S. Application Data

(60) Provisional application No. 62/704,197, filed on Apr. 27, 2020.

(51) Int. Cl.

| | |
|---|---|
| ***F21S 4/20*** | (2016.01) |
| ***F21V 21/088*** | (2006.01) |
| ***F21S 2/00*** | (2016.01) |
| ***F21V 19/00*** | (2006.01) |
| ***F21Y 115/10*** | (2016.01) |

(Continued)

(52) U.S. Cl.

CPC ..... *F21S 4/20* (2016.01); *F21S 2/005* (2013.01); *F21V 19/0055* (2013.01); *F21V 21/088* (2013.01); *F21W 2111/023* (2013.01); *F21W 2111/027* (2013.01); *F21Y 2115/10* (2016.08)

(58) Field of Classification Search

None

See application file for complete search history.

(56) References Cited

U.S. PATENT DOCUMENTS

| | | | |
|---|---|---|---|
| 3,740,541 | A | 6/1973 | Conradt |
| 4,161,769 | A | 7/1979 | Elliott |
| 4,367,517 | A | 1/1983 | Balzer |

(Continued)

FOREIGN PATENT DOCUMENTS

| | | |
|---|---|---|
| CN | 203615283 | 5/2014 |
| CN | 204187538 | 3/2015 |

(Continued)

OTHER PUBLICATIONS ledrabrands.com, Alphabet Bruck. Molto Luce, New Product Preview, 2017, Tustin, CA, USA.

(Continued)

*Primary Examiner* — Britt D Hanley

(74) *Attorney, Agent, or Firm* — Leviton Manufacturing Co., Inc.

(57) ABSTRACT

A light assembly mountable in an aperture formed in a railing or a light fixture. The light assembly may include a housing, first and second clamps, and first and second fasteners. The first fastener may couple the first clamp to the housing, and the second fastener may couple the second clamp to the housing. When the fasteners are rotated, the respective clamps pivot outward and move towards the railing or light fixture to retain the light assembly in the railing or the fixture. The light assembly may be removable from the aperture in the railing or the fixture.

24 Claims, 10 Drawing Sheets

(51) Int. Cl.
*F21W 111/023* (2006.01)
*F21W 111/027* (2006.01)

(56) References Cited

U.S. PATENT DOCUMENTS

| | | | |
|---|---|---|---|
| 6,425,676 | B1 | 7/2002 | Lyons |
| 7,188,978 | B2 | 3/2007 | Sharrah et al. |
| 8,210,705 | B2 | 7/2012 | Pesson et al. |
| 8,251,543 | B2 | 8/2012 | Bauer |
| 8,757,566 | B2 | 6/2014 | Nash |
| 9,206,953 | B2 | 12/2015 | Roos |
| 9,644,836 | B1 | 5/2017 | Field et al. |
| 10,215,377 | B2 | 2/2019 | Laurendet |
| 10,612,734 | B2 | 4/2020 | MacLeish et al. |
| 2008/0080173 | A1 | 4/2008 | Trimble et al. |
| 2008/0289294 | A1 | 11/2008 | Harrison et al. |
| 2008/0304253 | A1 | 12/2008 | Handsaker |
| 2011/0090680 | A1 | 4/2011 | Steinkraus |
| 2017/0307198 | A1* | 10/2017 | Shah ..... F21V 5/04 |
| 2017/0336064 | A1 | 11/2017 | Simon et al. |
| 2019/0078771 | A1 | 3/2019 | Onodi et al. |
| 2019/0137057 | A1 | 5/2019 | MacLeish et al. |
| 2019/0178480 | A1 | 6/2019 | Cho et al. |
| 2019/0249854 | A1 | 8/2019 | Shen |

FOREIGN PATENT DOCUMENTS

| | | |
|---|---|---|
| CN | 102506352 | 6/2015 |
| CN | 105240741 | 1/2016 |
| DE | 102005041333 | 1/2007 |
| DE | 102008035520 | 7/2009 |
| DE | 102009042257 | 4/2011 |
| DE | 102012107008 | 2/2014 |
| DE | 102014003109 | 10/2015 |
| EP | 1724516 | 11/2006 |
| EP | 1918480 | 5/2008 |
| JP | 2005248423 | 9/2005 |
| WO | 2007006130 | 1/2007 |
| WO | 2019094758 | 5/2019 |

OTHER PUBLICATIONS

Thomas & Betts, Carlon Cable Management Systems that Make Installation Faster and Better, 2009.
Pentair, Adjustable Far-Side Box Support, Plastic—766PMD, 2017.

* cited by examiner

SECTION A-A

POINT SOURCE LIGHT ASSEMBLY

CROSS-REFERENCE TO RELATED APPLICATION

The present application claims the benefit of the filing date of, and priority to U.S. Provisional Patent Application Ser. No. 62/704,197, filed Apr. 27, 2020, entitled "POINT SOURCE LIGHT MODULE," the entirety of which application is incorporated by reference herein.

FIELD OF THE DISCLOSURE

The present disclosure relates to a light assembly, and more particularly, relates to a point source light assembly.

DESCRIPTION OF THE RELATED ART

Lighting may typically be used in railing applications to provide light for walkways, stairs, paths, etc. Other applications may require a light fixture to have a light source that illuminates light to a particular direction or location/point. However, many of these lighting devices require multiple components during assembly in the field, making installation and replacement of these devices difficult. It would be desirable to have a lighting device that provides for more efficient installation, removal, and replacement in the field.

SUMMARY

A light assembly mountable in an aperture formed in a railing is disclosed. The light assembly preferably includes a housing, first and second fasteners, and first and second clamps. The first clamp is pivotally coupled to the housing via the first fastener, and the second clamp is pivotally coupled to the housing via the second fastener. In addition, the first and second clamps are movable between a first position and another position. When the first and second clamps are in the first position, the housing can be inserted in the aperture formed in the railing. When the first and second clamps are in the other position, the housing is retained in the aperture formed in the railing.

A method of installing a light assembly to a railing is also disclosed. The railing may have an aperture formed therein. The method preferably includes the step of providing the light assembly, in which the light assembly may include first and second clamps, first and second fasteners, and a housing including first and second channels. The first and second clamps are pivotally coupled to the housing via the respective first and second fasteners, and the first and second clamps may be positioned at least partially in the respective first and second channels. The method also includes the steps of inserting the light assembly through the aperture formed in the railing, rotating the first fastener to pivot the first clamp outward with respect to the housing and move toward the railing until the clamp contacts the railing, and rotating the second fastener to pivot the second clamp outward with respect to the housing and move toward the railing until the second clamp contacts the railing.

A light assembly mountable to a fixture is also disclosed. The fixture may have an aperture formed therein. The light assembly preferably includes a housing including a perimeter, first and second fasteners, and first and second clamps. The first clamp is pivotally coupled to the housing via the first fastener, and the second clamp is pivotally coupled to the housing via the second fastener. In addition, the first and second clamps are movable between a first position and another position. When the first and second clamps are in the first position, the first and second clamps do not extend substantially beyond the perimeter of the housing and the light assembly may be inserted through the aperture formed in the fixture. When the first and second clamps are in the other position, the first and second clamps extend beyond the perimeter of the housing and retain the light assembly to the fixture.

BRIEF DESCRIPTION OF THE DRAWING(S)

One or more aspects of the disclosed subject matter are particularly pointed out and distinctly claimed as examples in the claims at the conclusion of the specification. The foregoing and other objects, features, and advantages of the disclosed subject matter may be more readily understood by one skilled in the art with reference being had to the following detailed description of several embodiments thereof, taken in conjunction with the accompanying drawings wherein like elements are designated by identical reference numerals throughout the several views, and in which:

DETAILED DESCRIPTION

Figure 1:
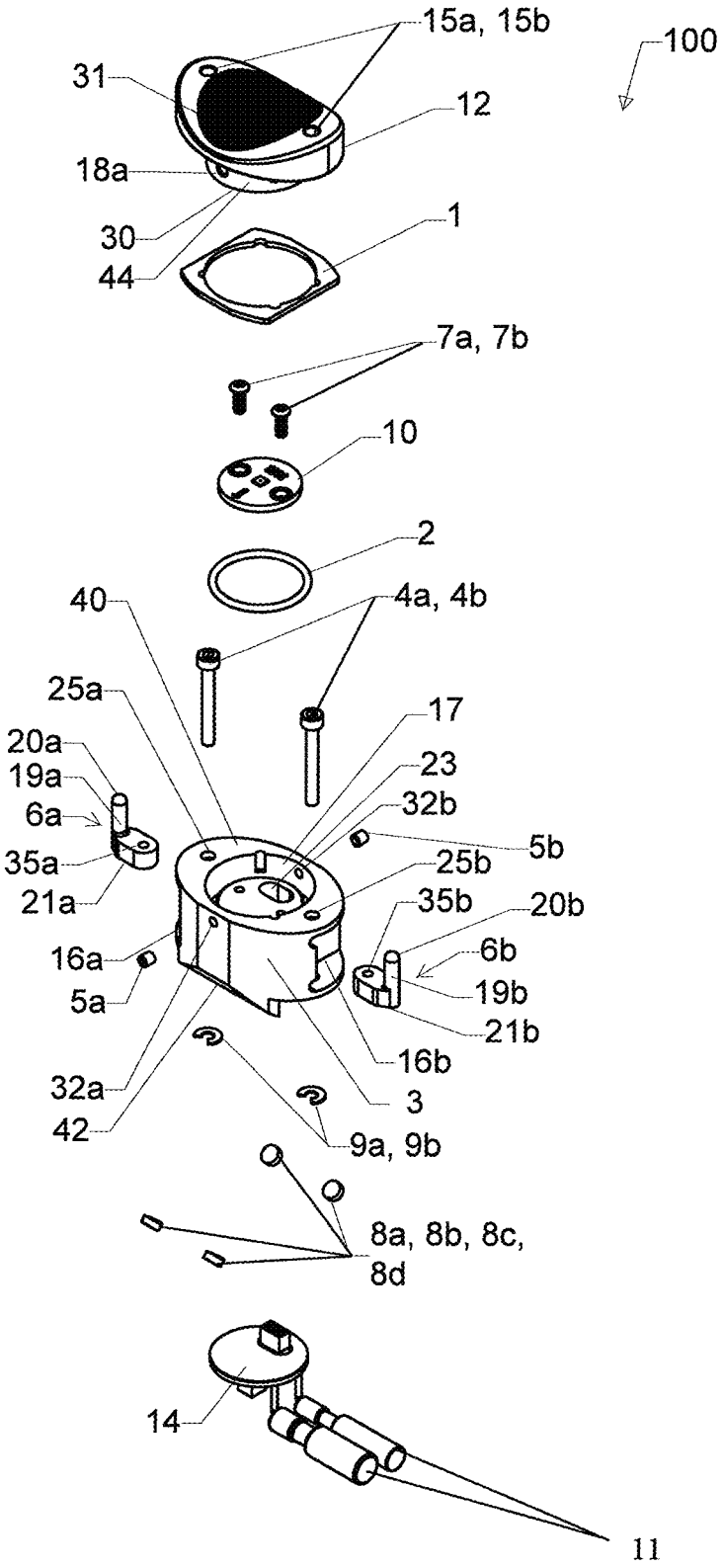
FIG. 1 is an exploded view of an exemplary embodiment of a light assembly.

The following disclosure is intended to provide exemplary embodiment(s) of the disclosed system and method, and these exemplary embodiment(s) should not be interpreted as limiting. One of ordinary skill in the art will understand that the steps and methods disclosed may easily be reordered and manipulated into many configurations, provided they are not mutually exclusive. As used herein, "a" and "an" may refer to a single or plurality of items and should not be interpreted as exclusively singular unless explicitly stated.

The present disclosure describes a point source light assembly for use with a light fixture or a railing. Embodiments will be described below while referencing the accompanying figures. The accompanying figures are merely examples and are not intended to limit the scope of the present disclosure.

FIGS. 1-4 illustrate an exemplary embodiment of a light assembly 100. The light assembly 100 may include a housing 3, first and second clamps 6*a* and 6*b*, a lens (such as but not limited to a symmetric lens 12), a light source (such as but not limited to a light emitting diode printed circuit board (LED PCB) 10), and a driver printed circuit board (driver PCB) 14. The driver PCB 14 is coupled to positive and negative wire connectors 11, which in some embodiments may be waterproof. In this exemplary embodiment, positive and negative wire connectors 11 are configured to be electrically coupled to any suitable source of Direct Current (DC) line voltage via an internal wiring harness. However, one of ordinary skill in the art will understand that other embodiments may be configured to be electrically coupled to any suitable source of Alternating Current (AC) line voltage or low voltage power via an internal wiring harness. Line voltage refers to a voltage, that is supplied to buildings/residences (e.g., electric light and power), for example, 110 VAC, 115 VAC, 120 VAC, 125 VAC, 208 VAC, 220 VAC, 230 VAC, 240 VAC, single or multiphase. Low voltage refers to a voltage which is less than a certain threshold (50 Volts for example, AC or DC). In one embodiment, positive and negative wire connectors 11 are configured to be electrically coupled to a 24 Volt (V) DC power source.

The housing 3 may include two channels, a first channel 16*a* formed in one side of the housing 3 and a second channel 16*b* formed in another side of the housing 3. The housing 3 may also include two recesses, a first recess 17 formed in a top surface 40 of the housing 3 and a second recess 37 (see FIG. 4) formed in a bottom surface 42 of the housing 3. In addition, first aperture 25*a* may extend from the top surface 40 of the housing 3 to the first channel 16*a*. Similarly, second aperture 25*b* may extend from the top surface 40 of the housing 3 to the second channel 16*b*.

Figure 4:
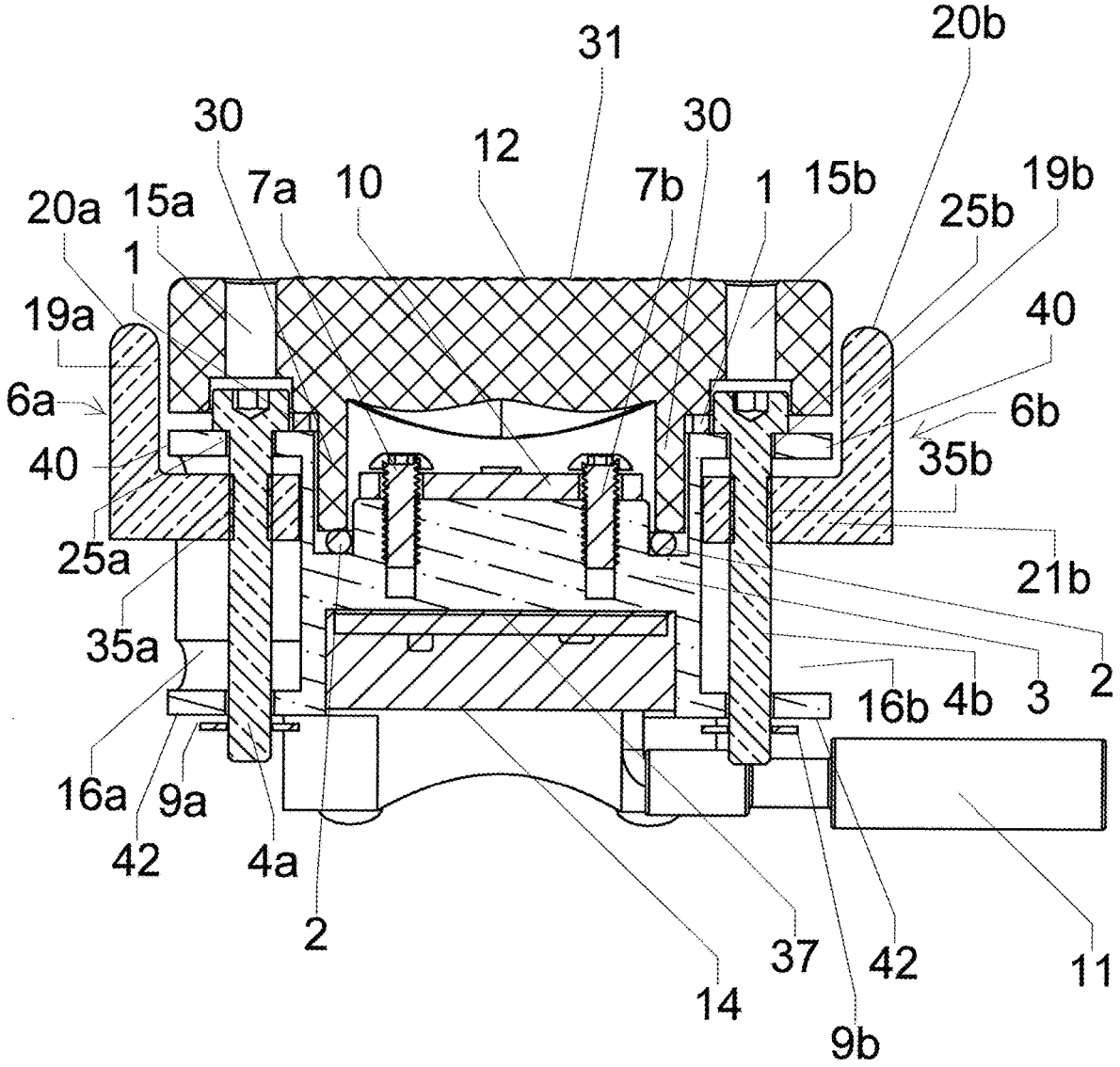
FIG. 4 is a sectional view of the light assembly FIG. 3 taken along section line A-A.
Figure 8:
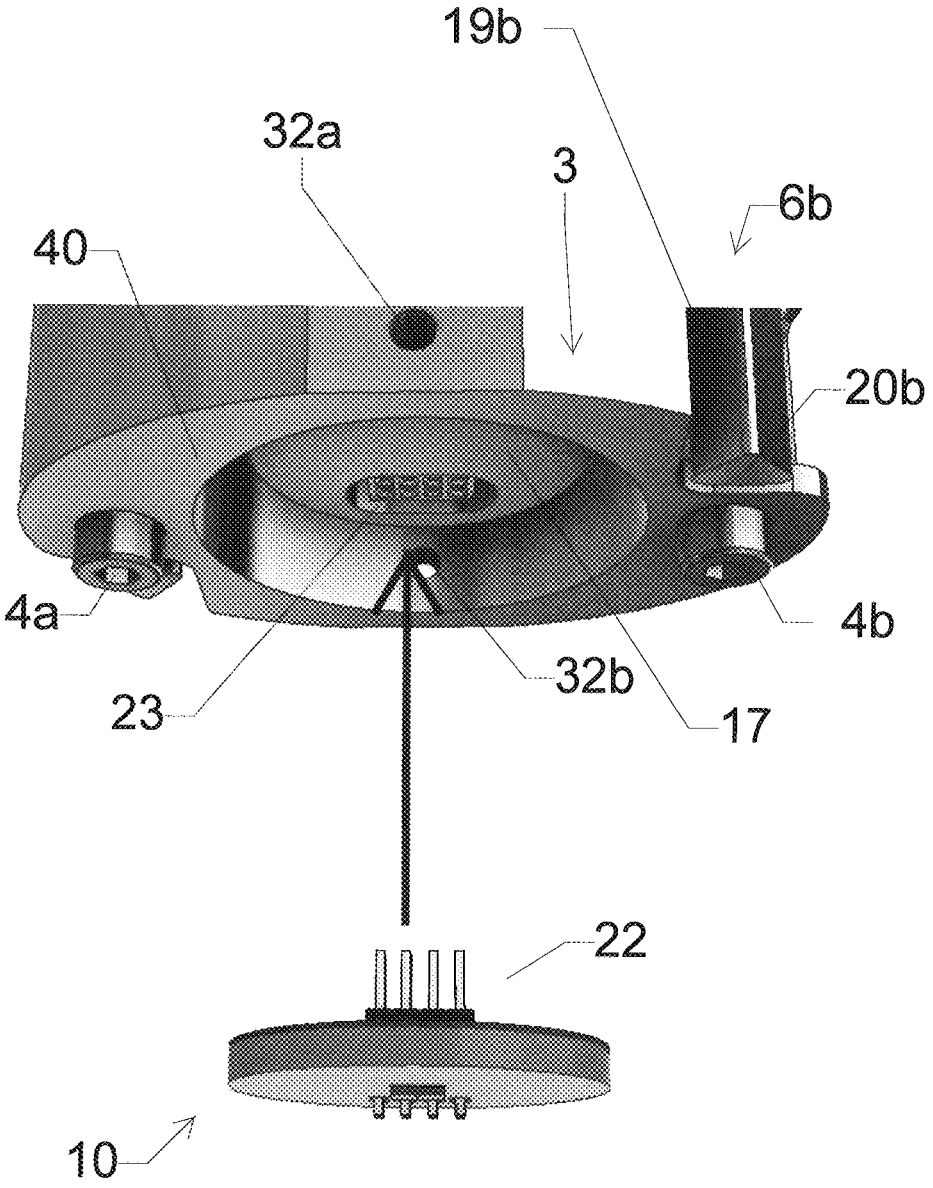
FIG. 8 is an exploded view of a subassembly of the light assembly of FIGS. 1-4.

The first recess 17 formed in the top surface 40 of the housing 3 and the second recess 37 formed in the bottom surface 42 of the housing 3 are configured such that the LED PCB 10 may be positioned in the first recess 17 and the driver PCB 14 may be positioned in the second recess 37. The LED PCB 10 may include a male power connector 22, and the housing 3 may include a female power connector 23 (see FIG. 8). The LED PCB 10 may be mounted to the housing 3 by coupling the corresponding male and female connectors 22, 23. Further, the LED PCB 10 may be attached to the housing 3 by at least one fastener (i.e., fasteners 7*a*, 7*b* as shown in FIG. 4).

Figure 2:
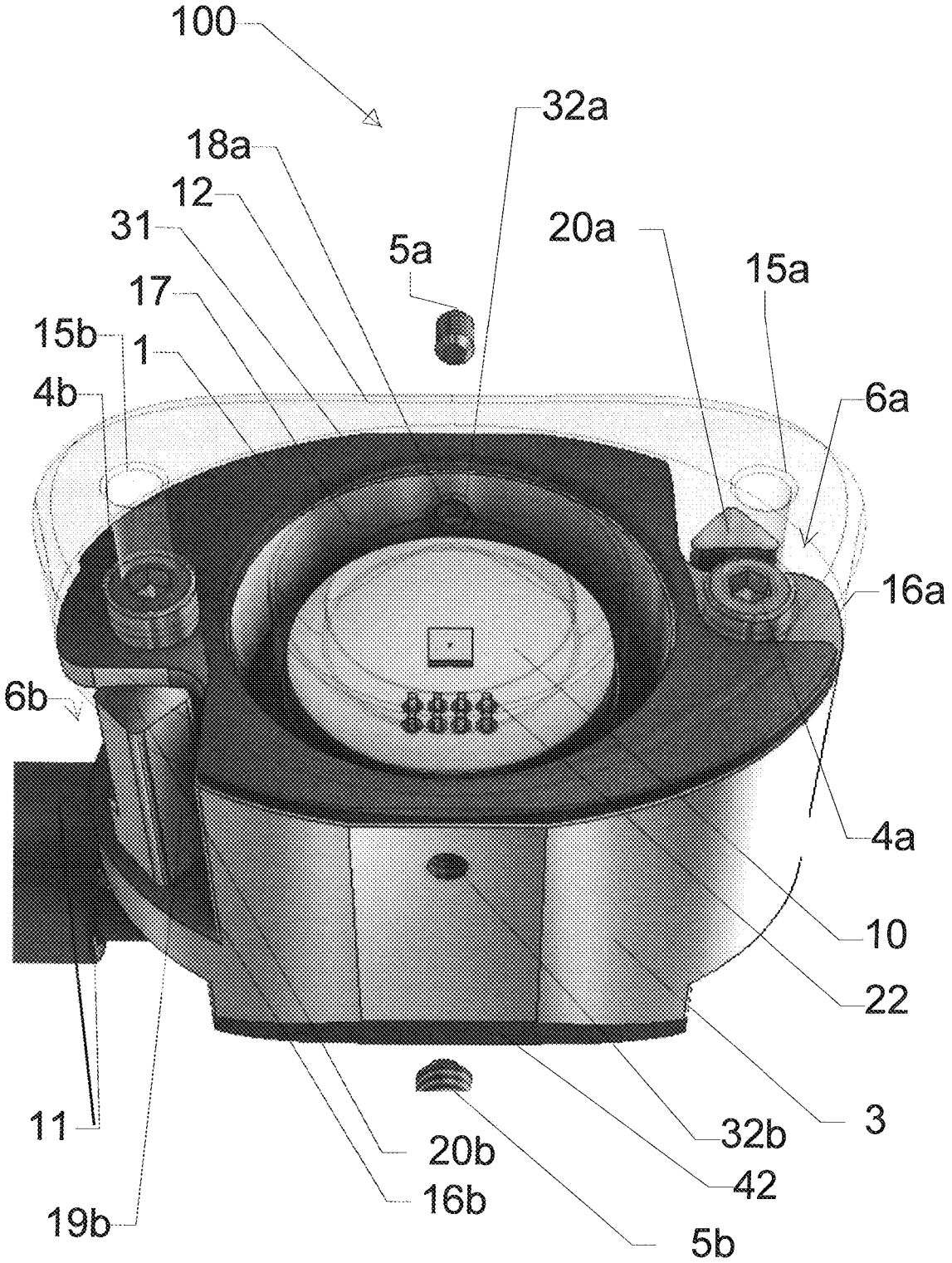
FIG. 2 is a subassembly and a symmetric lens of the light assembly of FIG. 1, in which the symmetric lens is aligned with the subassembly.
Figure 3:
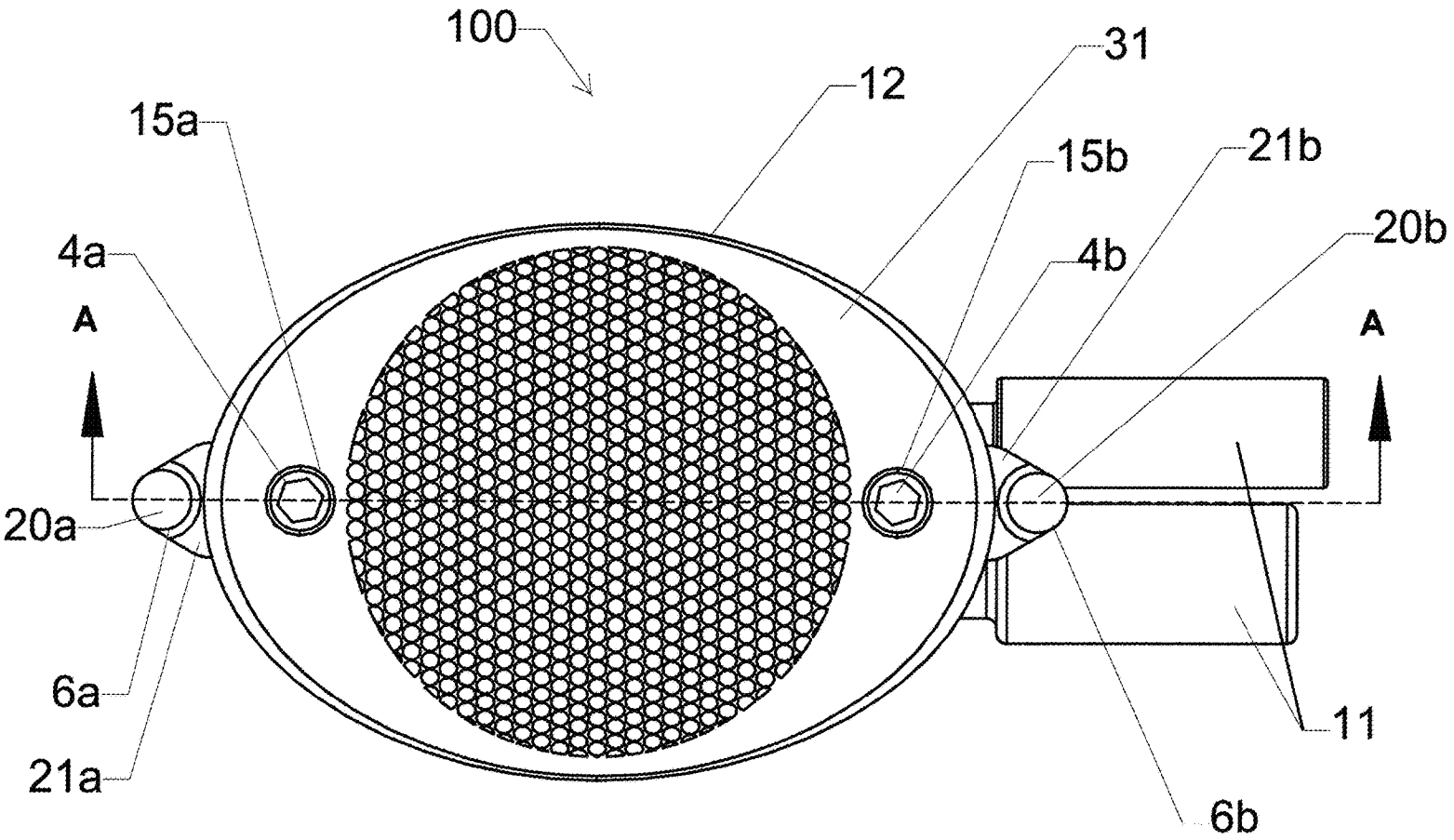
FIG. 3 is an assembled top view of the light assembly of FIG. 1.
Figure 6:
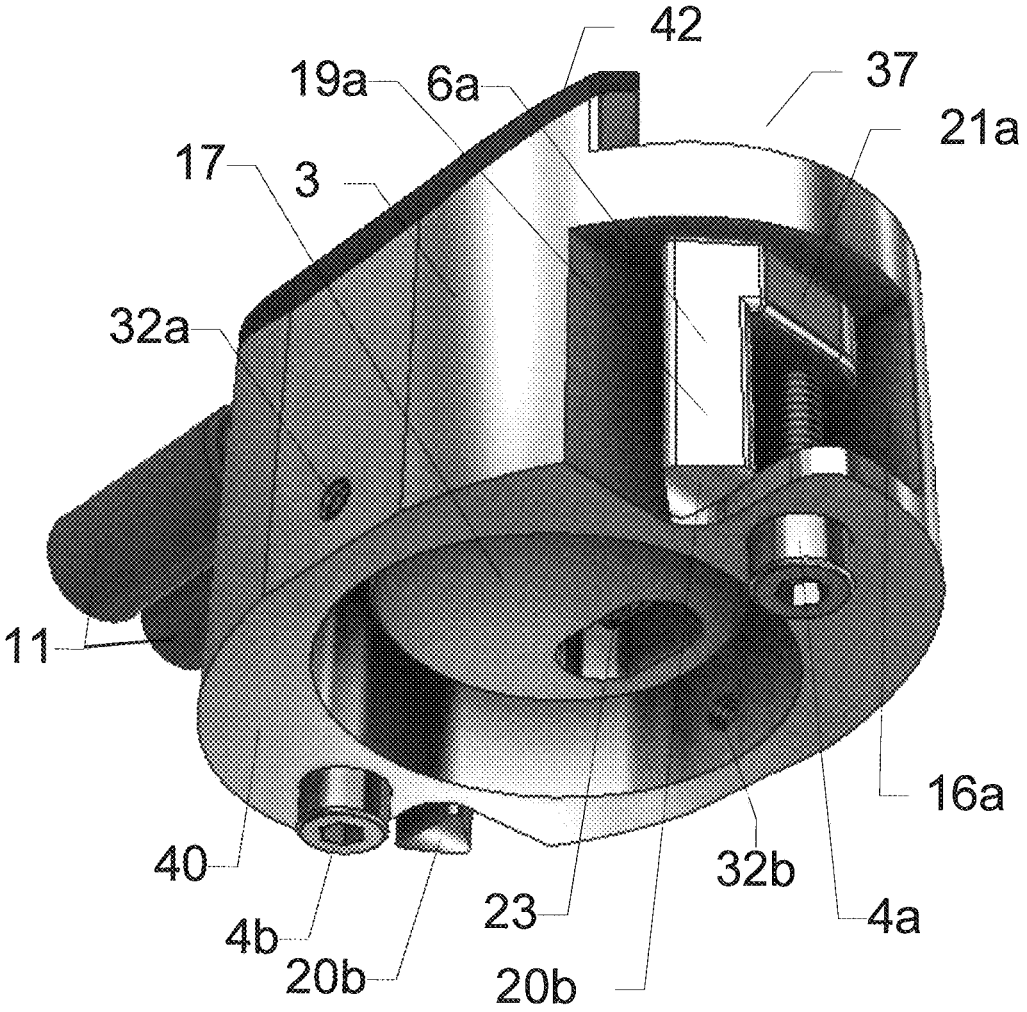
FIG. 6 is a subassembly of the light assembly of FIGS. 1-4.

As shown in FIGS. 1-2, 6, the first and second channels 16*a*, 16*b* of the housing 3 are configured such that the first clamp 6*a* may be aligned with, or positioned at least partially within, the first channel 16*a*; and the second clamp 6*b* may be aligned with, or positioned at least partially within, the second channel 16*b*. The first clamp 6*a* may include a leg 19*a* and a base 21*a*. The leg 19*a* may include a top surface 20*a*. The base 21*a* may include an aperture 35*a* extending therethrough. Likewise, the second clamp 6*b* may include a leg 19*b* and a base 21*b*. The leg 19*b* may include a top surface 20*b*. The base 21*b* may include an aperture 35*b* extending therethrough.

The first and second clamps 6*a*, 6*b* may be coupled to the housing 3 via first and second fasteners 4*a*, 4*b*, respectively. Fasteners 4*a*, 4*b*, may be of any suitable type such as but not limited to hex socket cap screws. That is, the first clamp 6*a* may be aligned with the first channel 16*a* such that the first fastener 4*a* extends through the aperture 25*a* formed in the housing 3 and the aperture 35*a* formed in the base 21*a* of the first clamp 6*a*. Likewise, the second clamp 6*b* may be aligned with the second channel 16*b* such that the second fastener 4*b* extends through the aperture 25*b* formed in the housing 3 and the aperture 35*b* formed in the base 21*b* of the second clamp 6*b*. In some embodiments, a "C" clamp 9*a* may be used to assist in maintaining the position of the first fastener 4*a*, and a "C" clamp 9*b* may assist in maintaining the position of the second fastener 4*b*. That is, the apertures formed in the housing 3 that the fasteners 4*a*, 4*b* extend therethrough may not be threaded, and the clamps 9*a*, 9*b* may be threaded with the clamps 9*a*, 9*b* maintaining the position of the respective fastener 4*a*, 4*b*. This prevents the fasteners 4*a*, 4*b* from coming out of the subassembly, and therefore prevents the respective clamps 6*a*, 6*b* from coming out of the subassembly.

As described in more detail below, as the first fastener 4*a* is rotated in a first direction, the first clamp 6*a* pivots such that the leg 19*a* moves outward with respect to the housing 3; then, the first clamp 6*a* moves closer to the lens 12. Similarly, as the second fastener 4*b* is rotated in a first direction, the second clamp 6*b* pivots such that the leg 19*b* moves outward with respect to the housing 3; then, the second clamp 6*b* moves closer to the lens 12.

As the first fastener 4*a* is rotated in a second direction, the first clamp 6*a* moves away from the lens 12; then, the first clamp 6*a* pivots such that the leg 19*a* moves towards the housing 3 and into the first channel 16*a*. Similarly, as the second fastener 4*b* is rotated in a second direction, the second clamp 6*b* moves away from the lens 12; then, the second clamp 6*b* pivots such that the leg 19*b* moves towards the housing 3 and into the second channel 16*b*. FIGS. 2 and 6 show the clamp(s) in their respective channels.

As shown in FIGS. 1-4, the lens 12 may include a top 31 and a base 30. The top 31 of the lens 12 may include first and second apertures 15*a*, 15*b* extending therethrough. In addition, the base 30 of the lens 12 may include a side wall 44, in which a third aperture 18*a* may extend at least partially through a portion of the side wall 44. In some embodiments, a fourth aperture 18*b* (not shown) may extend at least partially through another portion of the side wall 44.

As shown in FIGS. 1-4, the lens 12 may align with the housing 3 such that the third aperture 18*a* formed in the base 30 of the lens 12 may align with an aperture 32*a* formed in the side of the housing 3. In some embodiments, the fourth aperture 18*b* (not shown) formed in the base 30 of the lens 12 may align with an aperture 32*b* formed in another side of the housing 3. The lens 12 may be coupled to the housing 3 via fastener 5*a* (and in some embodiments, fastener 5*b*). That is, the fastener 5*a* may be positioned at least partially within the third aperture 18*a* formed in the base 30 of the lens 12 and the aperture 32*a* formed in the side of the housing 3. In some embodiments, the other fastener 5*b* may be positioned at least partially within the fourth aperture 18*b* (not shown) formed in the base 30 of the lens 12 and the aperture 32*b* formed in another side of the housing 3.

When the lens 12 is coupled to the housing 3, the first aperture 15*a* extending through the top 31 of the lens 12 is substantially aligned with the fastener 4*a*, and the second aperture 15*b* extending through the top 31 of the lens 12 is substantially aligned with the fastener 4*b*. As discussed in more detail below, the first and second apertures 15*a*, 15*b* extending through the top 31 of the lens 12 provide for access to the fasteners 4*a*, 4*b*.

Figure 5C:
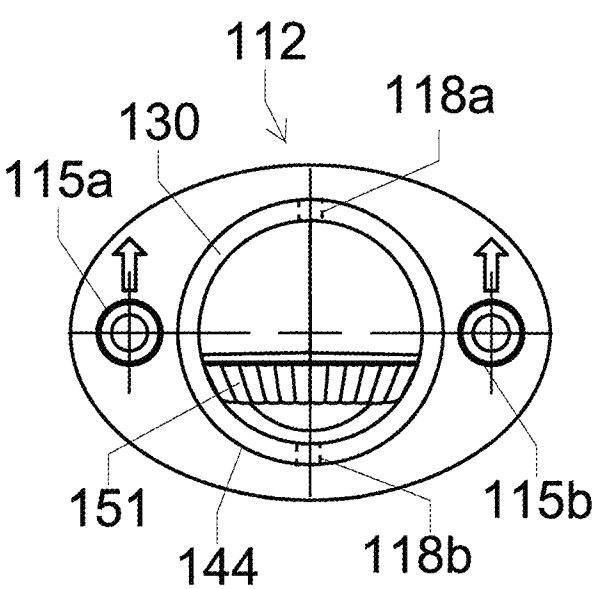
FIG. 5C is a bottom view of the asymmetric lens of FIGS. 5A-B.
Figure 5B:
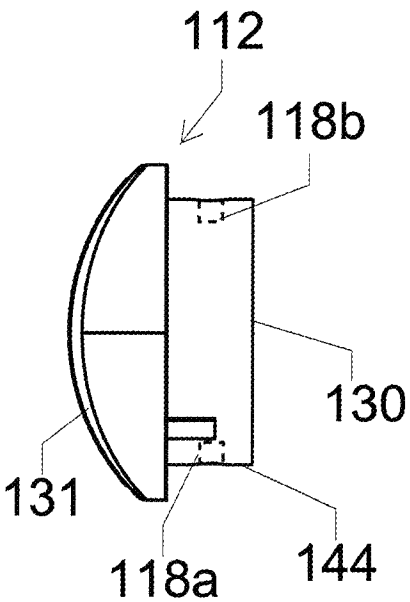
FIG. 5B is a side view of the asymmetric lens of FIG. 5A.
Figure 5A:
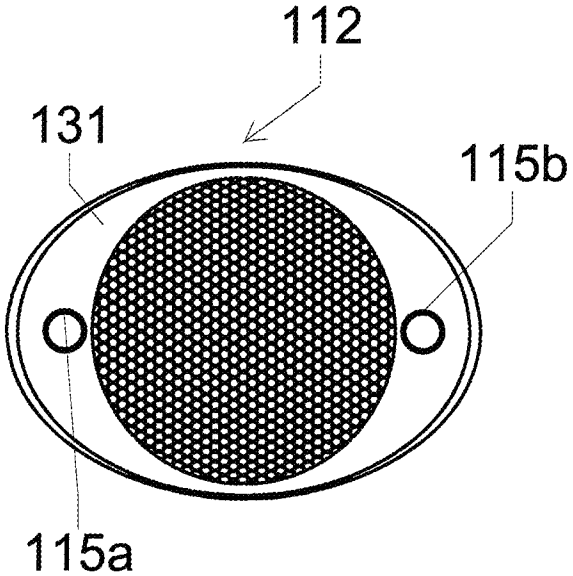
FIG. 5A is a top view of an asymmetric lens.

The lens may be a symmetric lens or an asymmetric lens. FIGS. 1-4 provide an exemplary embodiment of a symmetric lens 12, and FIGS. 5A-C provide an exemplary embodiment of an asymmetric lens 112. The asymmetric lens 112 is substantially similar to the symmetric lens 12 with respect to its in their mechanical features, as described herein. However, at least one difference between the symmetric lens 12 and the asymmetric lens 112 are the optics. The asymmetric lens 112 directs light to one side of the light fixture or railing while the optic 151 of the lens 112 is bilateral symmetrical. This differs from the symmetrical lens 12 in which the symmetrical lens 12 directs light to both sides of the light fixture or railing while the optic of the lens 12 is symmetrical about two axes.

A gasket 1 may be positioned between the lens 12 and the housing 3 to provide a water resistant seal. In some embodiments, the gasket 1 may have adhesive on at least one surface. In addition, another gasket 2 may be positioned in the recess 17 of the housing 3 to provide an additional water resistant seal. Compression gaskets 8*a-d* may be positioned on the bottom surface 42 of the housing 3.

In use, the light assembly 100 is assembled as described herein, and the first and second clamps 6*a*, 6*b* are positioned at least partially within the respective first and second channels 16*a*, 16*b* of the housing 3 (i.e., as the clamps 6*a*, 6*b* are configured and shown in FIGS. 2 and 6). This configuration of the clamps 6*a*, 6*b* is denoted as a first position.

Figures 7A, 7B, 7C:
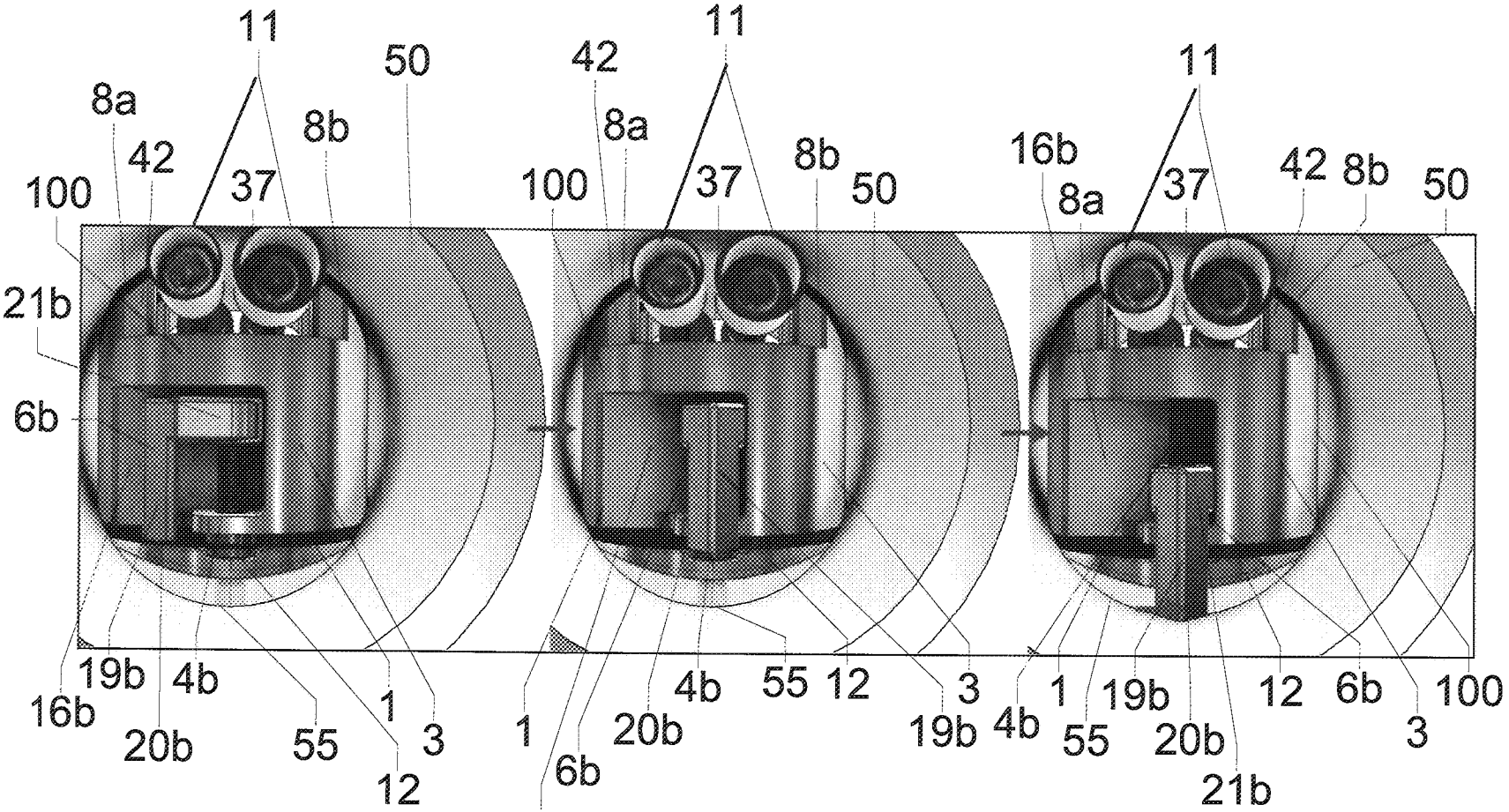
FIG. 7A is a side view of the light assembly of FIGS. 1-4 in a first configuration, in which the light assembly is in an aperture formed in a railing.
FIG. 7B is a side view of the light assembly of FIGS. 1-4 in a second configuration, in which the light assembly is in an aperture formed in a railing.
FIG. 7C is a side view of the light assembly of FIGS. 1-4 in a third configuration, in which the light assembly is in an aperture formed in a railing.

The wire connectors 11 may be connected to an internal wire harness (not shown) in a railing 50 (i.e., FIG. 7A). The light assembly 100, with the clamps 6*a*, 6*b* configured in the first position, may be inserted into an aperture formed in the railing 50, as shown in FIG. 7A. A tool, such as but not limited to a hex driver, may be inserted into the aperture 15*a* that extends through the lens 12 to rotate the first fastener 4*a* in the first direction. As the first fastener 4*a* is rotated in the first direction, the first clamp 6*a* pivots such that the first leg 19*a* moves outward with respect to the housing 3. This is denoted as a second position (as similarly shown in FIG. 7B with fastener 4*b* and clamp 6*b*). As the first fastener 4*a* is further rotated, the first clamp 6*a* moves closer to the lens 12 until the top 20*a* of the leg 19*a* contacts an inner wall 55 of the railing 50. This configuration is denoted as a third position (as similarly shown in FIG. 7C with fastener 4*b* and clamp 6*b*).

The tool may then be removed from the first aperture 15*a* extending through the lens 12 and inserted into the second aperture 15*b* extending through the lens 12 to rotate the second fastener 4*b* in the first direction. As the second fastener 4*b* is rotated in the first direction, the second clamp 6*b* pivots such that the second leg 19*b* moves outward with respect to the housing 3. This is denoted as a second position (shown in FIG. 7B). As the second fastener 4*b* is further rotated, the second clamp 6*b* moves closer to the lens 12 until the top 20*b* of the leg 19*b* contacts an inner wall 55 of the railing 50. This configuration is denoted as a third position (shown in FIG. 7C). The tool may then be removed from the second aperture 15*b* extending through the lens 12. The light assembly 100 is secured in the railing 50, and the lens 12 of the light assembly 100 may be relatively flush with the outer surface of the railing 50.

Alternatively, the light assembly 100 may be secured to the railing such that first and second fasteners 4*a*, 4*b*, are partially rotated in the first direction iteratively until the lens 12 is flush with the outer surface of the railing 50. By proceeding in this manner, the light assembly 100 may remain in general alignment with respect to the railing 50 when rotating fasteners 4*a*, 4*b*.

Compression gaskets 8*a-d* are positioned on the bottom surface 42 of the housing 3 and may contact other portions of the inner wall 55 of the railing 50. The compression gaskets 8*a-d* allow for tolerance to accommodate for differences in railing sizes or diameters.

The light assembly 100 is removable from the railing by rotating the first and second fasteners 4*a*, 4*b* in the second direction. That is, the tool may be inserted into the first aperture 15*a* that extends through the lens 12 to rotate the fastener 4*a* in the second direction. As the first fastener 4*a* is rotated, the first clamp 6*a* moves away from the lens 12 to the second position (as similarly shown in FIG. 7B with fastener 4*b* and clamp 6*b*), such that the leg 19*a* of the first clamp 6*a* moves away from the inner wall 55 of the railing 50. As the first fastener 4*a* is further rotated, the first clamp 6*a* pivots such that the leg 19*a* moves towards the housing 3, retracting into the housing channel 16*a* to the first position (as similarly shown in FIG. 7A with fastener 4*b* and clamp 6*b*).

The tool may then be removed from the first aperture 15*a* extending through the lens 12 and inserted into the second aperture 15*b* extending through the lens 12 to rotate the second fastener 4*b* in the second direction. As the second fastener 4*b* is rotated in the second direction, the second clamp 6*b* moves away from the lens 12 to the second position (as shown in FIG. 7B), such that the leg 19*b* of the second clamp 6*b* moves away from the inner wall 55 of the railing 50. As the second fastener 4*b* is further rotated, the second clamp 6*b* pivots such that the leg 19*b* moves towards the housing 3, retracting into the housing channel 16*b* to the first position (as shown in FIG. 7A). The tool may then be removed from the second aperture 15*b* extending through the lens 12, and the light assembly 100 may be removed from the aperture formed in the railing 50.

Alternatively, the light assembly 100 may be removed from the railing such that first and second fasteners 4*a*, 4*b* are partially rotated in the second direction iteratively.

In the embodiments disclosed, the fastener(s) may be any fastener now or hereafter known in the art including, but not limited to, a serrated head fastener, a washer head fastener, a conventional screw, a washer head screw, a serration screw, a hex screw (i.e., hex socket cap screw), an ovular screw, a thread screw, a set screw, a self-tapping screw, clasp, pin, stud, rod, bolt, or the like. The fastener(s) may have any suitable type of head, or it may be headless, for example as in the case of a set screw. In addition, the fastener(s) may be configured to be driven by any suitable tool or drive configuration, such as but not limited to a hex drive, an allen drive, slotted/straight blade drive, Phillips/cross drive, 6-point star/torx drive, square/Robertson drive, or the like. A drive or other suitable tool may engage a mating groove/recess on the top of the fastener.

In the exemplary embodiment described, the light assembly is inserted into a rail, such as but not limited to a handrail or guardrail. However, one of ordinary skill in the art will appreciate that it is within the scope of the disclosure that the light assembly may alternatively be used with other applications, such as but not limited to a post, pole, fitting, and the like. Further, the light assembly may be used in other applications besides the applications already described. For example, the light assembly may be used in a light fixture in which a point source light is required or desired. It will also be appreciated by one of ordinary skill in the art that the light assembly may be used in new, existing, or retrofit applications.

Figure 9:
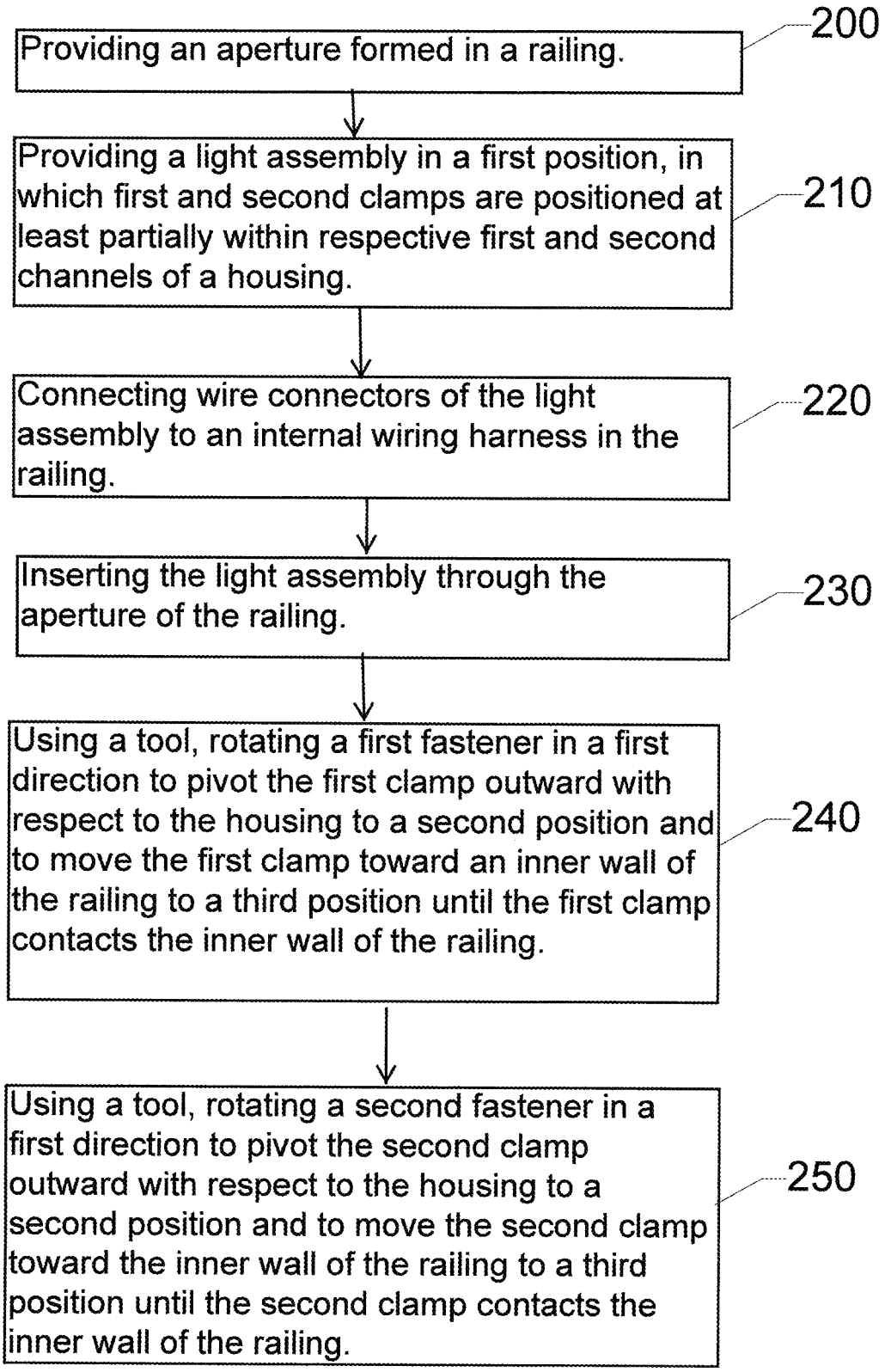
FIG. 9 is a method for installing a light assembly in a railing.

A method for installing a light assembly in a railing will now be described. Referring to FIG. 9, at STEP 200, providing an aperture formed in a railing; at STEP 210, providing a light assembly in a first position, in which first and second clamps are positioned at least partially within respective first and second channels of a housing; at STEP 220, connecting wire connectors of the light assembly to an internal wiring harness in the railing; at STEP 230, inserting the light assembly through the aperture of the railing; at STEP 240, using a tool, rotating a first fastener in a first direction to pivot the first clamp outward with respect to the housing to a second position and to move the first clamp toward an inner wall of the railing to a third position until the first clamp contacts the inner wall of the railing; and, at STEP 250, using a tool, rotating a second fastener in a first direction to pivot the second clamp outward with respect to the housing to a second position and to move the second clamp toward the inner wall of the railing to a third position until the second clamp contacts the inner wall of the railing.

Figure 10:
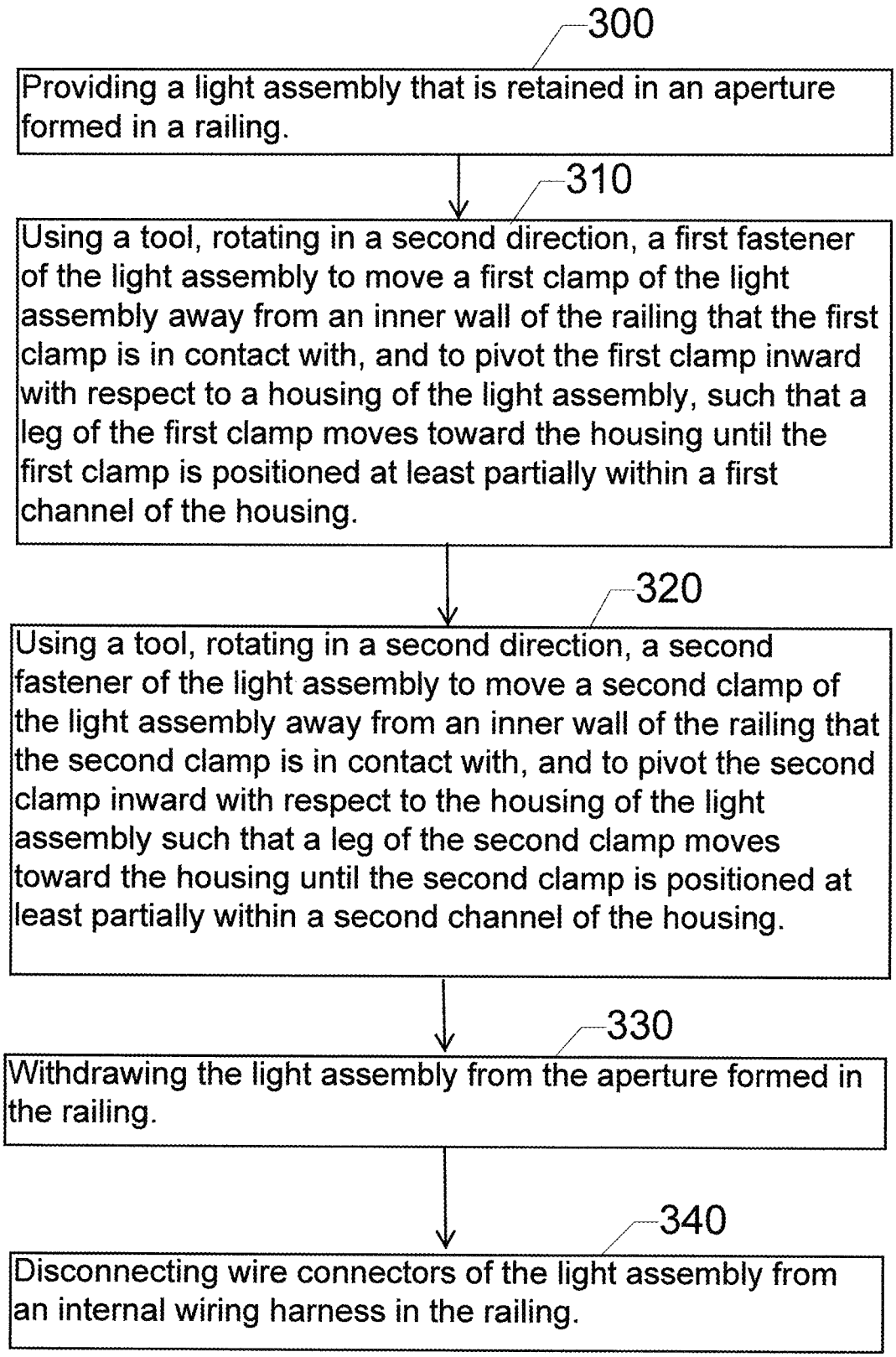
FIG. 10 is a method for removing a light assembly from a railing.

A method for removing a light assembly from an aperture formed in a railing will now be described. Referring to FIG. 10, at STEP 300, providing a light assembly that is retained in an aperture formed in a railing, in which first and second clamps of the light assembly are in contact with an inner wall of the railing (third position); at STEP 310, using a tool, rotating in a second direction, a first fastener of the light assembly to move a first clamp of the light assembly away from the inner wall of the railing (to a second position), and to pivot the first clamp inward with respect to a housing of the light assembly (to a first position), such that a leg of the first clamp moves toward the housing until the first clamp is positioned at least partially within a first channel of the housing; at STEP 320, using a tool, rotating in a second direction, a second fastener of the light assembly to move a second clamp of the light assembly away from the inner wall of the railing (to the second position), and to pivot the second clamp inward with respect to the housing of the light assembly (to the first position), such that a leg of the second clamp moves toward the housing until the second clamp is positioned at least partially within a second channel of the housing; at STEP 330, withdrawing the light assembly from the aperture formed in the railing; and STEP 340, disconnecting wire connectors of the light assembly from an internal wiring harness in the railing.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. For example, the light assembly may be used in other applications besides rail applications, including but not limited to use in light fixtures. Those skilled in the art will envision additional modifications, features, and advantages within the scope and spirit of the claims appended hereto.

What is claimed is:

1. A light assembly mountable in an aperture formed in a railing, the assembly comprising:

a. a housing having a surface;

b. first and second fasteners; and c. first and second clamps, the first clamp pivotally coupled to the housing via the first fastener, the second clamp pivotally coupled to the housing via the second fastener, the first and second clamps movable between a first position and another position, wherein the housing is inserted in the aperture formed in the railing when the first and second clamps are in the first position, the housing is at least partially insertable into the aperture formed in the railing; and wherein the housing is retained in the aperture formed in the railing when the first and second clamps are in the other position, the housing is retained at least partially within the aperture formed in the railing by:

a first force exerted by the first clamp against a first portion of the railing;

a second force exerted by the second clamp against a second portion of the railing; and a third force exerted by the surface of the housing against a third portion of the railing; wherein the third force is exerted in a different direction than one or more of the first and second forces, and wherein the first, second and third forces are exerted from within the aperture formed in the railing.

2. The light assembly of claim 1, wherein the housing comprises first and second channels, and wherein the first clamp is at least partially within the first channel and the second clamp is at least partially within the second channel when the first and second clamps are in the first position.

3. The light assembly of claim 1, wherein when the first and second clamps move from the first position to the other position, the first and second clamps pivot outward with respect to the housing and toward the railing at least until the respective clamp contacts the railing.

4. The light assembly of claim 1, wherein when the first and second clamps move from the other position to the first position, the first and second clamps move away from the railing and pivot inward with respect to the housing until the respective first and second clamps are at least partially within the respective first and second channel.

5. The light assembly of claim 1, wherein when the first and second fasteners are rotated in a first direction, the respective first and second clamps move from the first position to the other position, and wherein when the first and second fasteners are rotated in a second direction, the respective first and second clamps move from the other position to the first position.

6. The light assembly of claim 1 further comprising a light source.

7. The light assembly of claim 1 further comprising a lens coupled to the housing.

8. The light assembly of claim 7, wherein the lens includes first and second apertures extending therethrough, and wherein the first and second fasteners are accessible via the respective first and second apertures of the lens.

9. The light assembly of claim 7, wherein the railing includes an outer wall, wherein the lens includes a top surface, and wherein the top surface of the lens is substantially flush with the outer wall of the railing when the first and second clamps are in the other position.

10. The light assembly of claim 7 further comprising a third fastener, wherein the housing includes a wall with at least one aperture extending therethrough, wherein the lens includes at least one aperture extending at least partially through the lens, wherein the at least one aperture extending through the wall of the housing substantially aligns with the at least one aperture at least partially extending through the lens to attach the lens to the housing via the third fastener.

11. The light assembly of claim 6, wherein the light source comprises a light emitting diode printed circuit board.

12. The light assembly of claim 1, wherein the light assembly is removable from the aperture formed in the railing when the first and second clamps are in the first position.

13. A method of installing a light assembly to a railing, the railing having an aperture formed therein, the method comprising the steps of:

a. providing the light assembly, the light assembly including first and second clamps, first and second fasteners, and a housing including first and second channels and a surface, wherein the first and second clamps are pivotally coupled to the housing via the respective first and second fasteners, and wherein the first and second clamps may be positioned at least partially in the respective first and second channels;

b. inserting the light assembly through housing at least partially into the aperture formed in the railing;

c. rotating the first fastener to pivot the first clamp outward with respect to the housing and move toward the railing at least until the first clamp contacts the railing;

d. rotating the second fastener to pivot the second clamp outward with respect to the housing and move toward the railing at least until the second clamp contacts the railing; and e. retaining the housing at least partially within the aperture formed in the railing by:

i. exerting a first force by the first clamp against a first portion of the railing;

ii. exerting a second force by the second clamp against a second portion of the railing; and iii. exerting a third force by the surface of the housing against a third portion of the railing;

wherein the third force is exerted in a different direction than one or more of the first and second forces, and wherein the first, second and third forces are exerted from within the aperture formed in the railing.

14. The method of claim 13 further comprising the step of removing the light assembly from the railing by rotating the first fastener to move the first clamp away from the railing and pivot inward with respect to the housing, rotating the second fastener to move the second clamp away from the railing and pivot inward with respect to the housing, and removing the housing from the aperture formed in the railing.

15. A light assembly mountable to a fixture, the fixture having an aperture formed therein, the light assembly comprising:

a. a housing including a perimeter and a surface;

b. first and second fasteners;

c. first and second clamps, the first clamp pivotally coupled to the housing via the first fastener, the second clamp pivotally coupled to the housing via the second fastener, the first and second clamps movable between a first position and another position, wherein when the first and second clamps are in the first position, the first and second clamps do not extend substantially beyond the perimeter of the housing and the light assembly housing may be inserted through at least partially into the aperture formed in the fixture; and wherein when the first and second clamps are in the other position, the first and second clamps extend beyond the perimeter of the housing and retain the light assembly to the fixture, and the housing is retained at least partially within the aperture formed in the fixture by:

a first force exerted by the first clamp against a first portion of the fixture;

a second force exerted by the second clamp against a second portion of the fixture; and a third force exerted by the surface of the housing against a third portion of the fixture;

wherein the third force is exerted in a different direction than one or more of the first and second forces, and wherein the first, second and third forces are exerted from within the aperture formed in the fixture.

16. The light assembly of claim 15 further comprising:

a. a light source; and, b. a lens coupled to the housing, wherein the lens at least partially covers the light source.

17. The light assembly of claim 15, wherein when the first and second clamps are in the first position, the light assembly may be removed from the aperture formed in the fixture.

18. The light assembly of claim 15, wherein the housing includes first and second channels, wherein when the first and second clamps are in the first position, the first clamp is at least partially within the first channel and the second clamp is at least partially within the second channel.

19. The light assembly of claim 1, wherein the surface of the housing includes at least one compression gasket.

20. The method of claim 13, wherein the surface of the housing includes at least one compression gasket.

21. The light assembly of claim 15, wherein the surface of the housing includes at least one compression gasket.

22. The light assembly of claim 1, wherein the surface is a bottom surface.

23. The method of claim 13, wherein the surface is a bottom surface.

24. The light assembly of claim 15, wherein the surface is a bottom surface.

* * * * *